US009853374B2

(12) United States Patent
Ranaivoson

(10) Patent No.: US 9,853,374 B2
(45) Date of Patent: Dec. 26, 2017

(54) ELECTRICAL CABLE CLAMP HAVING OVERLAPPING CONTACT MEMBERS WITH INSULATING COVER

(71) Applicant: Toky Ranaivoson, Ottawa (CA)

(72) Inventor: Toky Ranaivoson, Ottawa (CA)

( * ) Notice: Subject to any disclaimer, the term of this patent is extended or adjusted under 35 U.S.C. 154(b) by 0 days.

(21) Appl. No.: 14/999,727

(22) PCT Filed: Dec. 18, 2014

(86) PCT No.: PCT/CA2014/051237
§ 371 (c)(1),
(2) Date: Jun. 17, 2016

(87) PCT Pub. No.: WO2015/089670
PCT Pub. Date: Jun. 25, 2015

(65) Prior Publication Data

US 2017/0040719 A1 Feb. 9, 2017

Related U.S. Application Data

(60) Provisional application No. 61/917,813, filed on Dec. 18, 2013.

(51) Int. Cl.

| | |
|---|---|
| ***H01R 4/24*** | (2006.01) |
| ***H01R 4/26*** | (2006.01) |
| ***H01R 11/24*** | (2006.01) |
| ***H01R 13/631*** | (2006.01) |

(52) U.S. Cl.
CPC ..... *H01R 11/24* (2013.01); *H01R 13/631* (2013.01); *H01R 2201/26* (2013.01)

(58) Field of Classification Search
CPC . H01R 4/24; H01R 4/26; H01R 11/00; H01R 11/02; H01R 11/20; H01R 11/24; H01R 11/281; H01R 11/288; H01R 13/631; H01R 25/003; H01R 31/06; H01R 2201/26; H05K 2201/10803
USPC ..... 439/388, 501–506
See application file for complete search history.

(56) References Cited

U.S. PATENT DOCUMENTS 1,521,197 A * 12/1924 Lewis ..... H01R 11/24 439/822
2,000,665 A * 5/1935 Neal ..... H01R 11/282 324/426
2,468,823 A * 5/1949 Housepian ..... A61B 17/2812 128/849

(Continued)

*Primary Examiner* — Chandrika Prasad
(74) *Attorney, Agent, or Firm* — George A. Seaby

(57) ABSTRACT

An electrical cable clamp for releasably securing an electrical cable to a part includes a pair of clamp members, a pair of opposed contact surfaces and a spring. Each of the clamp members comprises a handle portion and a jaw portion. Each of the contact surfaces is attached to a different one of the jaw portions. One or both of the contact surfaces is formed by an electrically conductive member. The clamp members are pivotally connected to allow movement of the clamp members between a closed position in which the clamp members collectively form an electrically insulating external surface encasing the electrically conductive member, and an open position in which the contact surfaces are separated from each other and exposed to receive the part therebetween. The spring biases the clamp members towards the closed position.

5 Claims, 6 Drawing Sheets

(56) References Cited

U.S. PATENT DOCUMENTS

| | | | | | |
|---|---|---|---|---|---|
| 2,644,142 | A * | 6/1953 | Danberg | H01R 11/24 | 439/224 |
| 4,869,688 | A * | 9/1989 | Merio | H01R 11/24 | 320/105 |
| 5,316,498 | A * | 5/1994 | Hooper | H01R 11/24 | 206/388 |
| 5,611,714 | A * | 3/1997 | Krivec | F16C 11/12 | 439/759 |
| 7,736,201 | B2 * | 6/2010 | Gathman | H01R 11/24 | 439/759 |
| 7,909,662 | B2 * | 3/2011 | Gathman | H01R 11/24 | 439/759 |
| 2009/0247020 | A1 * | 10/2009 | Gathman | H01R 11/24 | 439/759 |

* cited by examiner

ELECTRICAL CABLE CLAMP HAVING OVERLAPPING CONTACT MEMBERS WITH INSULATING COVER

FIELD OF THE INVENTION

The present invention relates to electrical cable clamps for releasably securing an electrical cable to a part.

BACKGROUND TO THE INVENTION

In a variety of applications, it is desired to releasably connect an electrical cable to a part to conduct electricity to or from the part. As an example, a booster cable is used to conduct electricity from a battery terminal post of a charged battery of one vehicle to a battery terminal post of a discharged battery of another vehicle. A conventional booster cable comprises an electrically conductive lead with an attached clamp at each of its two ends for releasably securing the lead to a battery terminal post. The clamp includes a pair of pivotally attached clamp members, each defining a handle portion and a jaw portion. When the user squeezes the handle portions together, the jaw portions spread apart to receive the battery terminal post therebetween. When the user releases the handle portions, a spring biases the jaw portions together so that they clamp onto the battery terminal post.

In a conventional booster cable, the clamp members are made of an electrically conductive material such as copper. Although the handle portion is typically covered in a rubber sleeve, the electrically conductive material of the jaw portion remains exposed. Therefore, if the jaw portions are brought into contact with each other while the leads are connected to the charged battery, the jaw portions can "short circuit" and cause a spark that can ignite explosive hydrogen gas released from an overcharged battery. Further, the user may receive an electric shock if the user touches the exposed jaw portion.

Accordingly, there is a need in the art for an electrical cable clamp that may mitigate the deficiencies of conventional electrical cable clamps.

SUMMARY OF THE INVENTION

In one aspect, the invention comprises an electrical cable clamp for releasably securing an electrical cable to a part. The electrical cable clamp comprises a pair of clamp members, a pair of opposed contact members and a spring. The pair of clamp members each comprises a handle and a jaw. Each of the contact members is attached to a different one of the jaws. One or both of the contact members is electrically conductive member. The clamp members are pivotally connected to allow movement of the clamp members between a closed position and an open position. The clamp members have an electrically insulative cover that substantially encases or encases the clamp member or members. In the open position, the contact members are separated from each other and exposed to receive the part therebetween. The spring biases the clamp members towards the closed position.

In one embodiment, one or both of the jaw portions defines a pocket, and the electrically conductive member is retained within the pocket. The contact member is secured within the pocket by a friction fit or snap-tight fit, or a fastener such as a rivet, a screw, or a crimp connection. The fastener may be electrically insulated from the contact member by one or more electrically insulative gaskets or an electrically insulative coating.

In one embodiment, one or both of the jaws include a pocket, and in the closed position, the contact member attached to one of the jaws projects into the pocket in the other jaw. The pair of jaws may comprise an upper jaw and a lower jaw, and in the closed position, one electrically conductive contact member vertically overlaps the other contact member. The contact members may comprise at least one wall projecting from the attached jaw. The wall may extend longitudinally of the clamp member, or transverse to the longitudinal axis of the clamp member.

In one embodiment, at least one of the clamp members comprises an electrically conductive core and an electrically insulative cover on the core.

In one embodiment, the outer edges of the contact members are contoured to define a plurality of teeth. The plurality of teeth are located on two edges parallel the longitudinal axis of the clamp member.

In one embodiment, the contact member has an arcuate edge. The arcuate edge may be transverse to the longitudinal axis of the clamp member.

In embodiments, the spring is a torsion spring or a V-spring.

In one embodiment, the electrical cable clamp further comprises a central member, wherein the clamp members are pivotally connected by pivotal connection to the central member.

In one embodiment, the handle portion of at least one of the clamp members defines a channel to retain the electrical cable.

In embodiments, the electrical cable is connected to an electrical device or is an electrical lead of a booster cable.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted is but one of a number of possible arrangements utilizing the fundamental concepts of the present invention. The drawings are briefly described as follows.

DETAILED DESCRIPTION OF PREFERRED EMBODIMENTS

The invention relates to an electrical cable clamp for releasably securing an electrical cable to a part. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the scope of the invention, as defined in the appended claims.

The electrical cable clamp of the present invention may be used in a variety of applications to releasably secure an electrical cable to a part, such that the electrical cable clamp conducts electricity between the electrical cable and the part. It will be understood that neither the particular application of the electrical cable nor the part limits the claimed invention, unless so expressly indicated in the claims.

Figure 1A:
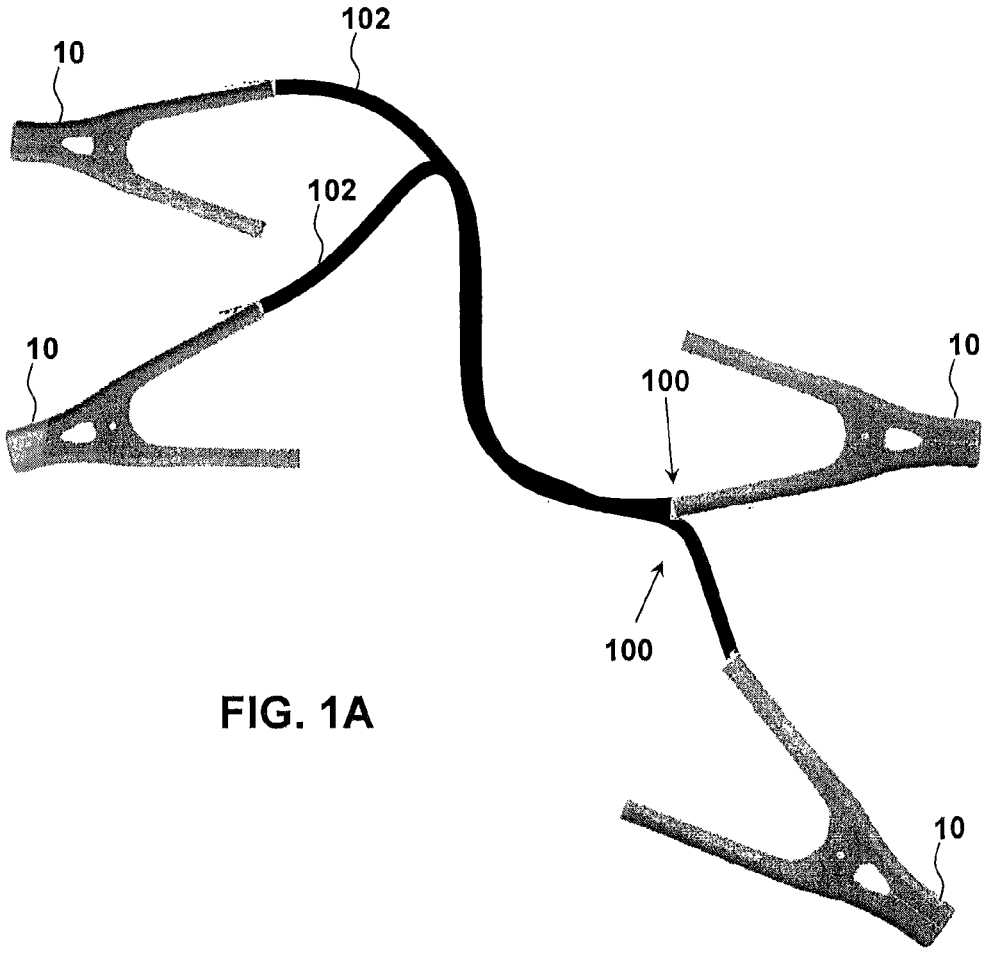
FIG. 1A shows a pair of booster cables having one embodiment of the electrical cable clamp of the present invention attached thereto.

In one non-limiting embodiment, the electrical cable clamp may be used to releasably secure an electrical lead of a booster cable to a battery terminal post, a connector attached thereto, or a grounding structure such as part of an engine block or a vehicle frame. FIG. 1A shows a pair of booster cables (100), each of which comprises a pair of booster cable leads (102). An electrical cable clamp (10) of the present invention is attached to each end of the leads (102). A conventional vehicle battery has a projecting battery terminal post with or without an attached connector that connects a lead connected to the electrical system of the vehicle. Each battery terminal post is typically substantially cylindrical in shape and typically has a height in the range of about 10 mm to 30 mm, and a diameter in the range of about 10 mm to 30 mm. The diameter of the battery terminal post may increase slightly from the free end of the battery terminal post to the end of the battery terminal post attached to the body of the battery. The battery post is typically made of a relatively soft electrically conductive material such as lead. The connector is typically a crimp-type connector that is tightened around the post using bolt-and-nut assembly. The foregoing description of the battery terminal post and the connector is provided only to facilitate the description of the present invention and does not limit the present invention, which may be adapted to a battery having a battery terminal post and attached connector of different type, shape and size.

Figure 1B:
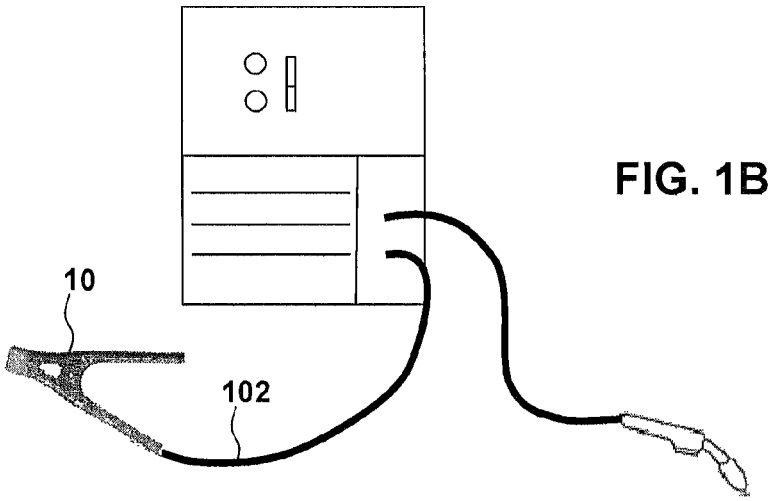
FIG. 1B shows an arc welding machine with an electrical ground cable having one embodiment of the electrical cable clamp of the present invention attached thereto.

In another non-limiting embodiment, the electrical cable clamp (10) may be used to secure an electrical cable of an electrical device. For example, FIG. 1B shows an arc welding machine with a grounding electrical cable (102) having one embodiment of the electrical cable clamp (10) of the present invention attached thereto to releasably secure the ground cable (102) to a work piece to be welded. Other types of electrical devices may include scientific or laboratory equipment.

Figure 2:
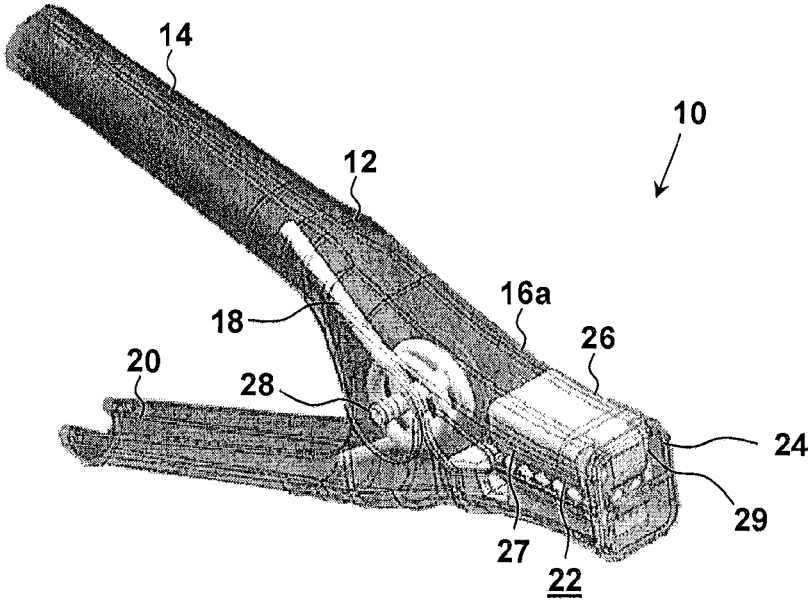
FIG. 2 is a wireframe perspective view of one embodiment of the electrical cable clamp of the present invention, in the closed position.

As shown in one embodiment in FIG. 2, the electrical cable clamp (10) of the present invention generally comprises a pair of clamp members (12) comprising a handle (14) and a jaw (16), opposed contact surfaces (22) on contact members (26) attached to the jaws (16), and a spring (18). At least one of the contact members (26) is electrically conductive, and in the embodiment shown in FIG. 2, both of the contact members (26) are electrical conductive. In the embodiments shown in the Figures, the pairs of components (i.e., the clamp members (12), the opposed contact members (26) are matching, unless otherwise noted. As such, it will be understood that the following description of one of the paired components may apply to the both of the components in the pair.

The handle (14) allows the user to grip the electrical cable clamp (10). In one embodiment, the handle (14) is an elongate member that defines an arcuate channel (20) for retaining part of the electrical cable (102) therein to avoid tangling of the electrical cable.

The jaws (16) pinch the battery terminal post between the opposed contact surfaces (22) to releasably secure the electrical cable clamp (10) to a part such as a battery terminal post. In one embodiment, the jaw (16) defines a pocket (24) that receives the electrically conductive contact member (26). The contact member (26) may be retained within the pocket (24) using any suitable fastening means known in the art. In one embodiment, the contact member (26) is retained in the pocket (24) by a friction fit or a snap fit. In other embodiments, the contact member (26) is retained in the pocket (24) by a fastener such as a rivet, a screw, or a crimp fastener.

The contact member (26) conducts electricity between the electrical cable (102) and a part to be connected thereto, such as a battery terminal post. It will be understood that the contact member (26) is connected to the electrical cable (102) using any suitable connection known in art, including without limitation, a weld, a wire tie, or a wire connecting device such as a twist-on fastener, a crimp connector, or tape. The contact member (26) may be made of any electrically conductive material, including without limitation, copper.

Figure 4:
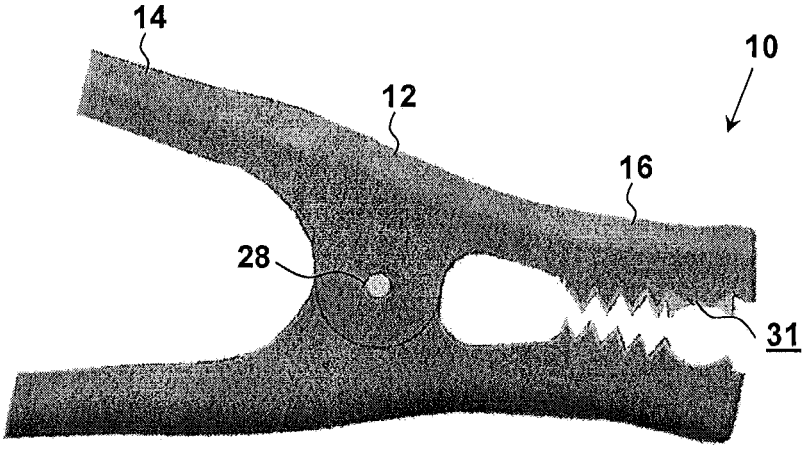
FIG. 4 is a perspective view of the embodiment of the electrical cable clamp shown in FIG. 2, in the open position.

In one embodiment as shown in FIG. 2, the contact member (26) is formed from a thin plate of copper that is bent to form three walls. Two of the walls (27) extend longitudinally of the clamp member (12) and one wall (29) extends transversely of the clamp member (12). The outer edges of the walls (27, 29) form contact surfaces (22). The edges of the walls (27) have contours defining a plurality of teeth to more securely clamp against a battery terminal post. In embodiments, the teeth may be angled as defined by a zigzag edge, or may be rounded as defined by a corrugated edge with a series of curved ridges and furrows. In embodiments, the edges of the walls may be sharpened or flat. In one embodiment as shown in FIG. 4, the walls (27) have an arcuate contour (31) that is configured to match the curved surface of a battery terminal post. In one embodiment as shown in FIG. 4, the walls of the jaws (16) that define the pockets (24) are contoured to match the contours of the contact member (26).

The clamp members (12) are pivotally connected to allow for their movement between a closed position and an open position. In one embodiment as shown in FIG. 2, the clamp members (12) are pivotally connected by a pin (28) passing through aligned apertures formed in the clamp members (12). In the open position, as shown in one embodiment in FIG. 4, the contact members (26) are separated from each other and externally exposed to receive therebetween the part to which the electrical cable (102) is to be connected.

Figure 3:
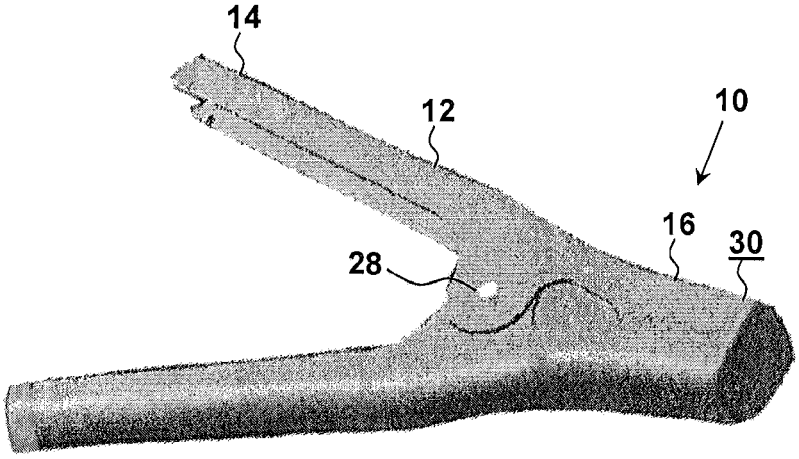
FIG. 3 is a perspective view of the embodiment of the electrical cable clamp shown in FIG. 2, in the closed position.

In the closed position, as shown in one embodiment in FIG. 3, the clamp members (12) collectively comprise an electrically insulative cover (30) either substantially encasing or encasing the electrically conductive members (26). As used herein, "substantially encasing" means that the cover (30) surrounds the electrically conductive contact member or members (26), with or without one or more openings that may allow for access to the contact members (26). As used herein, "encasing" means that the cover (30) defines an envelope that surrounds the contact member or members (26), without any opening that may allow for access to the contact members (26).

In one embodiment, the cover (30) may be monolithically formed with the rest of the clamp member (12), which is made of an electrically insulative material such as plastic. In other embodiments, the clamp member (12) comprises a core, and an electrically insulative layer that covers the core and forms part of the cover (30). The core may be made of an electrically conductive material such as metal, in which case the core may be integral with the contact member or members (26). The cover is made of any suitable electrically insulative material known in the art, such as polyvinyl chloride (PVC) or rubber. The cover may be applied to the core using any suitable method known in the art including, without limitation, wrapping, spraying, painting, or dip-coating.

The spring (18) biases the clamp members (12) towards the closed position. Any suitable type of spring (18) known in the art may be used. In one embodiment as shown in FIG. 2, the spring (18) comprises a torsion spring. The stiffness of the spring (18) may be selected so that when the user manually squeezes the handle portions (14), the clamp members (12) will move to the open position. When the user releases the handle portions (14), the spring (18) will bias the clamp members (12) towards the closed position, such that the contact members (26) clamp therebetween the part to be connected to the electrical cable (102).

Figure 5:
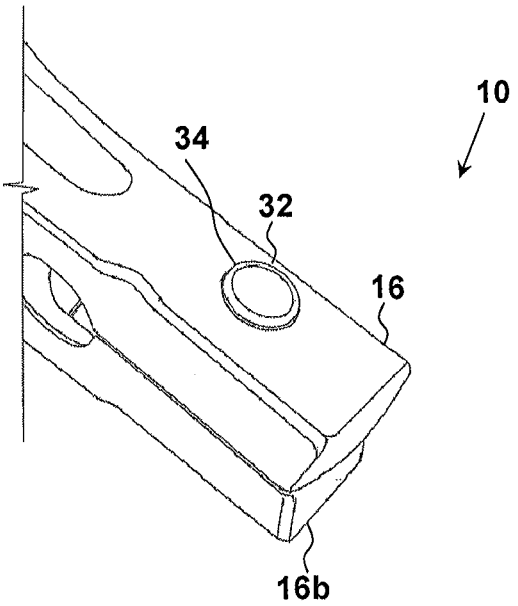
FIG. 5 is a perspective view of the jaw portion of an alternative embodiment of the electrical cable clamp of the present invention, in the closed position.
Figure 6:
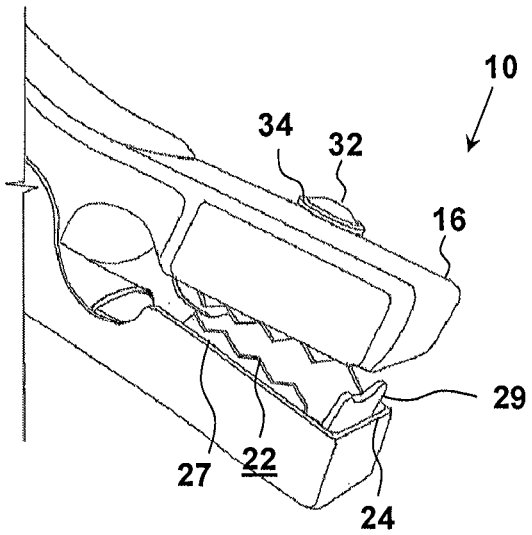
FIG. 6 is a perspective view of the jaw portion of the embodiment of the electrical cable clamp shown in FIG. 5, in the open position.
Figure 7:
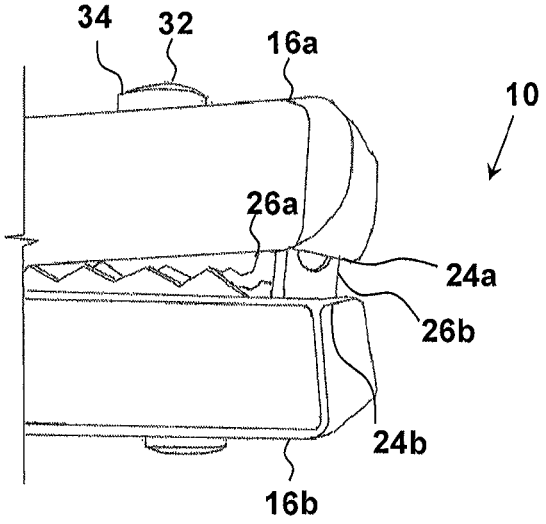
FIG. 7 is a perspective view of the jaw portion of the embodiment of the electrical cable clamp shown in FIG. 5, in between the closed position and the open position.

FIGS. 5-7 shown the jaws (16) of an alternative embodiment of the electrical cable clamp (10) of the present invention that is similar to the embodiment shown in FIG. 2. Elements of this embodiment of the electrical cable clamp (10) that are analogous to the embodiment shown in FIG. 2, are assigned the same reference numerals.

In one embodiment as shown in FIGS. 5-7, the contact member (26) is retained within the pocket (24) defined by the jaws (16) by a rivet (32). In one embodiment, the rivet (32) is made of metal, and is electrically isolated from the jaw (16) and the contact member (26) by one or more electrically insulative gaskets (34). In the embodiment shown in FIGS. 5-7, it will be understood that each jaw (16) has a gasket (34) (as is visible in these figures) between the head of the rivet (32) and the external surface (30) of the clamp member (12), and a gasket (concealed from view) between an opposite head of the rivet (32) and the contact member (26). The gasket (34) may be made of any suitable electrically insulative material known in the art, including without limitation, polyvinyl chloride (PVC), rubber or plastic. The rivet or other suitable fastener may be electrically insulated from the contact member (26) by other suitable means known in the art, such as by coating the rivet (32) or other fastener with an electrically insulating material.

In one embodiment as shown in FIGS. 5-7, the edges of the walls (27) of the contact member (26) that extend longitudinally of the clamp members (12) are contoured to define a plurality of teeth to more securely clamp against a part to be connected to the electrical cable. The edge of the wall (29) of the contact member (26) that extends transversely of the clamp member (12) has an arcuate contour configured to match the curved surface of a battery terminal post.

In one embodiment as shown in FIG. 7, when the clamp members (12) are in the closed position, the walls of the contact member (26*a*) that project from attached jaw (16*a*) project into the pocket (24*b*) defined by the other jaw (16*b*). Considering jaw (16*a*) to be an upper jaw, and jaw (16*b*) to be a lower jaw, the walls of the electrically conductive members (26*a*, 26*b*) overlap vertically with each other when in the closed position—that is, a horizontal plane will intersect the walls (27, 29) of both contact members (26*a*, 26*b*). Further, in the closed position, the walls (27, 29) of the contact member (26*b*) attached to jaw (16*b*) fit into a gap between the walls (27, 29) of the contact member (26*a*) attached to jaw (16*a*) and the walls of the jaw (16*a*) that define pocket (24*a*). This arrangement of the walls (27, 29) of the contact members (26*a*, 26*b*) is analogous to an "overbite" arrangement of upper and lower teeth in a human mouth. This arrangement allows the walls of the jaws (16) that define the pockets (24) to have straight edges that abut against each other when the clamp members (12) are in the closed position (as shown in FIG. 5), even though the contact members (26) project from these edges when the clamp members (12) are in the open position (as shown in FIG. 6). It also allows the jaws (16) to have a more compact configuration when the clamp members (12) are in the closed position and (as shown in FIG. 5) restricts access to the contact members 26*a* and 26*b*.

FIGS. 8-11 show an alternative embodiment of the electrical cable clamp (10) of the present invention. Elements of this embodiment of the electrical cable clamp (10) that are analogous to the embodiment shown in FIG. 2 are assigned the same reference numerals.

In this embodiment, when the clamp members (12) are in the closed position, the terminal ends of the jaws (16) are angled to collectively form a V-shaped bearing surface (36). The handle portion (14) cantilevers longitudinally of the clamp member (12). The user of the electrical cable clamp (10) may push on the handles (14) to force the V-shaped bearing surface (36) against a battery terminal post. The reactive force of the battery terminal post against the V-shaped bearing surface (36) will tend to force the clamp members (12) from the closed position to the open position, and allow the battery terminal post to slide between and along the contact members (26) of the jaws (16).

In this embodiment, the jaw (16) defines a pocket (24) that receives a block-like contact member (26) therein. The contact member (26) may be retained within the pocket (24) using any suitable means known in the art. In one embodiment, the contact member (26) is retained in the pocket (24) by a friction fit or a snap fit. The contact surfaces (22) are contoured with ridges to more securely clamp against the battery terminal post.

In this embodiment, the clamp members (12) are pivotally connected to each other via by pins (40) that pass through aligned apertures formed in a central member (38) and the contact members (26). In one embodiment, the central member (38) is made of an electrically insulative material. In one embodiment, the central member (38) is made of an electrically conductive material, and a pair of electrically insulative casing members (42) are fastened by threaded bolts to the central member (38) to form part of the electrically insulative external surface of the electrical cable clamp (10). In one embodiment, the central member (38) and the casing members (42) define an aperture (44) for through passage of an electrical cable (102) that is connected to one of the contact members (26).

In this embodiment, the spring (18) comprises a V-spring. The V-spring is retained by a pair of pins (46, 48) that pass through aligned apertures of the central member on either side of the apex of the V-spring. The arms of the V-spring bear against angled portions of the contact members (26) to bias the clamp members (12) toward the closed position.

Figure 8:
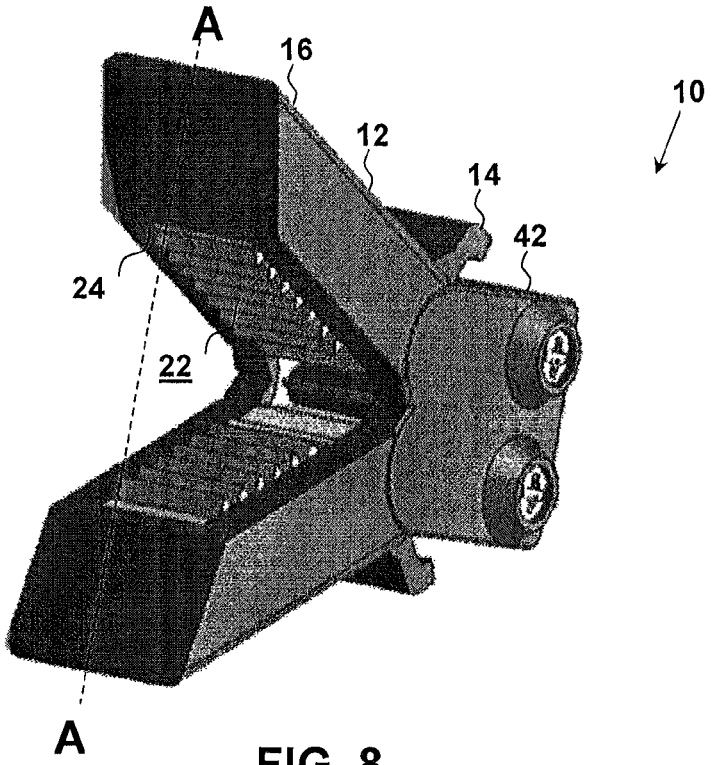
FIG. 8 is a perspective view of an alternative embodiment of the electrical cable clamp of the present invention, in the open position.
Figure 9:
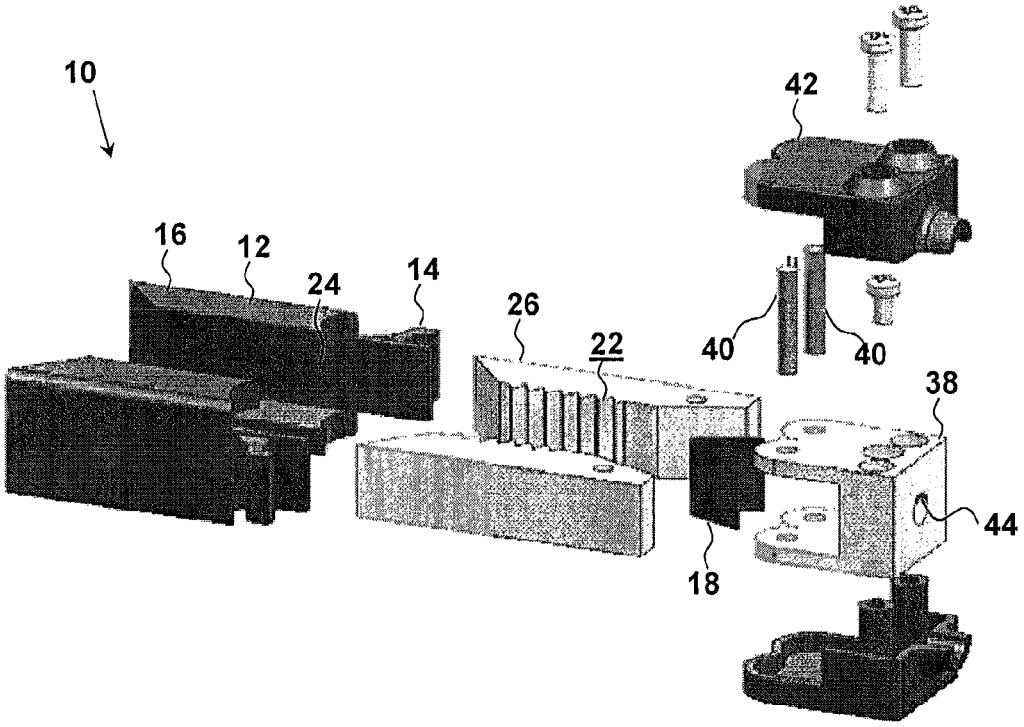
FIG. 9 is an exploded perspective view of the components of the embodiment of the electrical cable clamp shown in FIG. 8.
Figure 10:
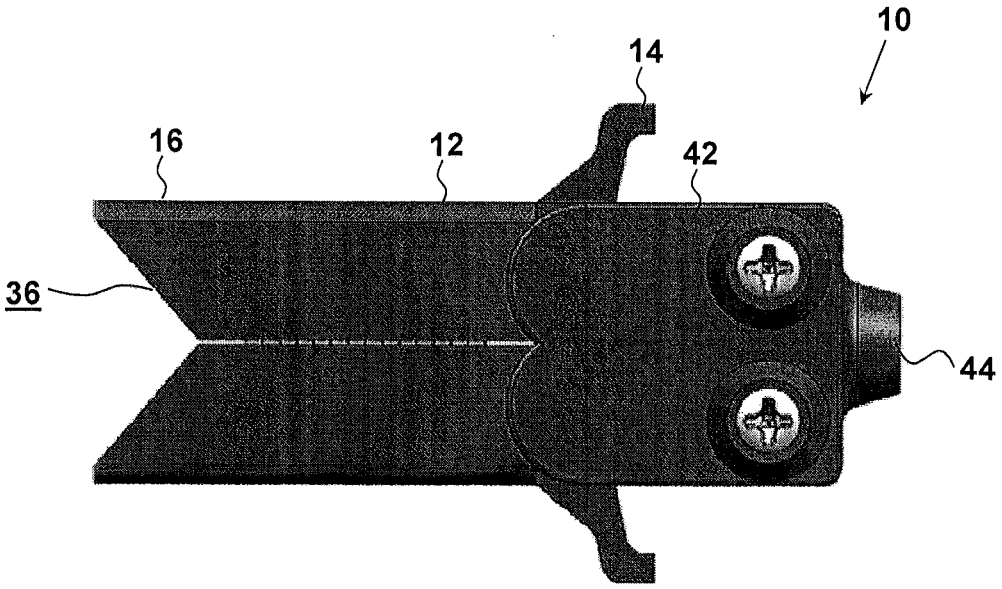
FIG. 10 is a side view of the embodiment of the electrical cable clamp shown in FIG. 8.
Figure 11:
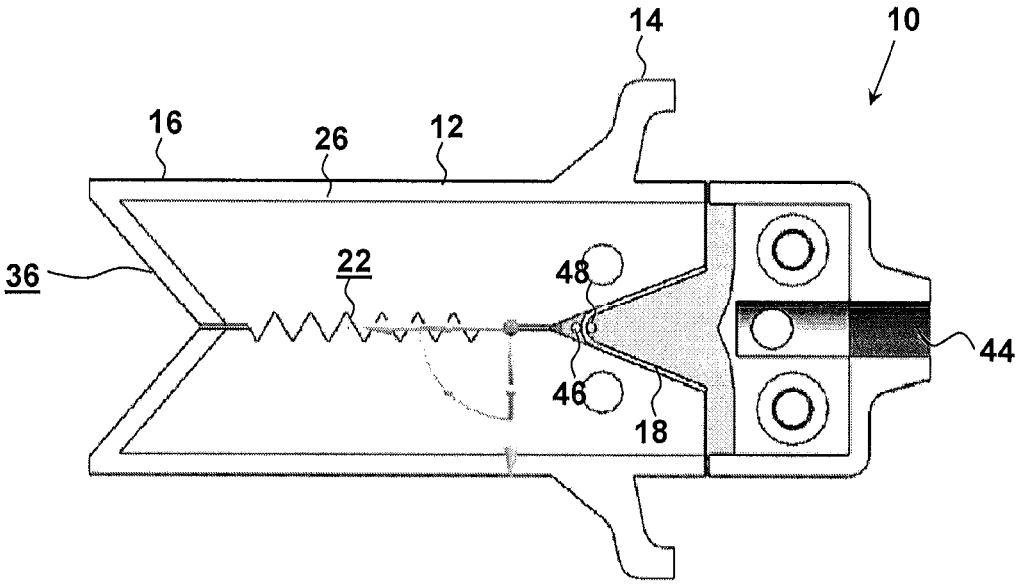
FIG. 11 is a sectional side view of the embodiment of the electrical cable clamp shown in FIG. 8, along line A-A in FIG. 8.
Figure 12:
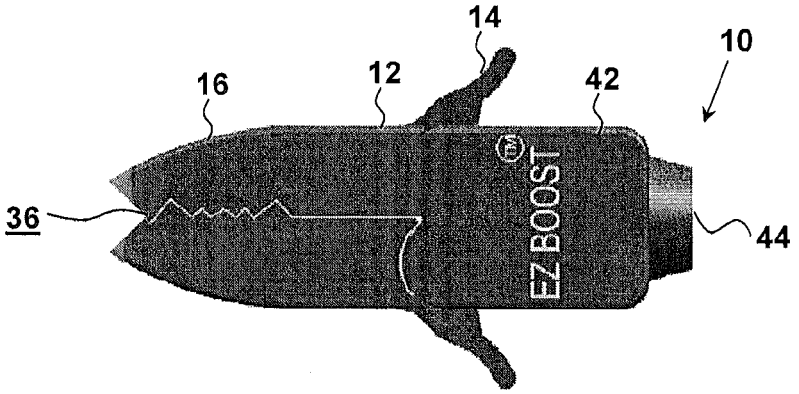
FIG. 12 is a side view of an alternative embodiment of the electrical cable clamp of the present invention, in the closed position.
Figure 13:
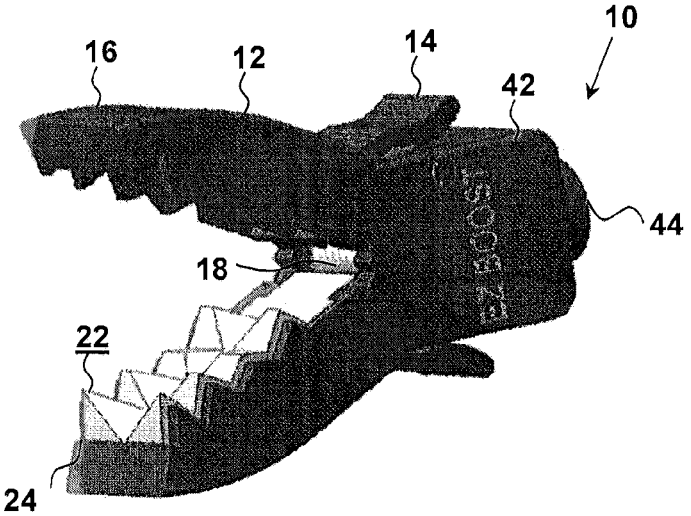
FIG. 13 is a perspective view of the embodiment of the electrical cable clamp shown in FIG. 12, in the open position.

FIGS. 12-13 show an alternative embodiment of the electrical cable clamp (10) of the present invention that is similar to the embodiment shown in FIG. 8. Elements of this embodiment of the electrical cable clamp (10) that are analogous to the embodiment shown in FIG. 8 are assigned the same reference numerals. In this embodiment, the spring (18) is a torsion spring. The contact surfaces (22) are pyramidal teeth arranged in two rows extending longitudinally of the clamp members (12) to more securely clamp against the battery terminal post. The walls of jaws (16) that define the pockets (24) that retain the contact members (26) have contours matching the contours of the contact surfaces (22).

Figure 14:
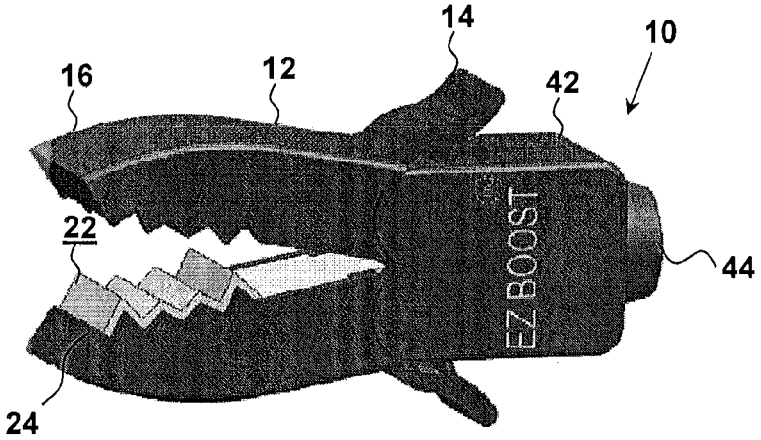
FIG. 14 is a perspective view of an alternative embodiment of the electrical cable clamp of the present invention, in the open position.

FIG. 14 shows an alternative embodiment of the electrical cable clamp (10) of the present invention that is similar to the embodiment shown in FIG. 12. Elements of this embodiment of the electrical cable clamp (10) that are analogous to the embodiment shown in FIG. 12 are assigned the same reference numerals. In this embodiment, the contact surfaces (22) are irregular ridges to more securely clamp against the battery terminal. The walls of jaw (16) that define the pocket (24) that retain the contact member (26) have contours matching the contours of the contact surfaces (22).

It will be appreciated that the electrical cable clamp (10) of the present invention may mitigate the risk of inadvertent contact between its electrically conductive contact members (26) and the user or other objects since they are substantially encased or encased within the electrically insulative external surface (30) of the clamp member (12), when in the closed position.

As will be apparent to those skilled in the art, various modifications, adaptations and variations of the foregoing specific disclosure can be made without departing from the scope of the invention claimed herein.

What is claimed is:

1. An electrical cable clamp for releasably securing an electrical cable to a part, the electrical cable clamp comprising:

a pair of clamp members, each comprising a handle and a jaw;

an electrically insulative cover encasing each jaw;

first and second electrically conductive, opposed contact members mounted in free ends of the jaws, each contact member including a pair of parallel, spaced apart sides, when in the closed position the sides of the first contact member overlapping the sides of the second contact member, whereby the insulative cover of one jaw abuts the insulative cover on the surface of the other jaw limiting access to the contact members;

a pin pivotally connecting the clamp members between the handles and the jaws permitting movement of the clamp members between a closed position and an open position in which the contact members are separated from each other and exposed for receiving the part therebetween; and a spring biasing the clamp members toward the closed position.

2. The electrical cable clamp of claim 1, wherein each jaw includes a pocket proximate its free end containing one said contact member.

3. The electrical cable clamp of claim 2 including a rivet securing said contact member in said pocket.

4. The electrical cable clamp of claim 3 including electrically insulative gaskets between one end of said rivet and said contact member, and between a second end of said rivet and an outer surface of said cover.

5. The electrical cable clamp of claim 4, wherein said contact members include a plurality of teeth on outer edges of said parallel sides for engaging the part when the jaws are closed against the part.

* * * * *